US010378222B1

(12) United States Patent
Elanmati

(10) Patent No.: US 10,378,222 B1
(45) Date of Patent: Aug. 13, 2019

(54) INFLATABLE SCAFFOLDING

(71) Applicant: Hicham Elanmati, Matawan, NJ (US)

(72) Inventor: Hicham Elanmati, Matawan, NJ (US)

( * ) Notice: Subject to any disclaimer, the term of this patent is extended or adjusted under 35 U.S.C. 154(b) by 235 days.

(21) Appl. No.: 15/458,097

(22) Filed: Mar. 14, 2017

(51) Int. Cl.

| | |
|---|---|
| ***E04G 1/18*** | (2006.01) |
| ***B66F 11/00*** | (2006.01) |
| ***E04G 1/22*** | (2006.01) |
| ***E04G 1/24*** | (2006.01) |
| ***E04G 5/14*** | (2006.01) |
| *B66F 11/04* | (2006.01) |

(52) U.S. Cl.
CPC ..... *E04G 1/22* (2013.01); *E04G 1/24* (2013.01); *E04G 5/14* (2013.01); *B66F 11/04* (2013.01)

(58) Field of Classification Search
CPC ..... E04G 1/18; E04G 1/22; E04G 11/045; E04G 1/34; B66F 3/35; B66F 31/12
See application file for complete search history.

(56) References Cited

U.S. PATENT DOCUMENTS

| | | | | |
|---|---|---|---|---|
| 2,070,334 A * | 2/1937 | Garber | G03B 15/07 | 182/113 |
| 3,556,481 A | 1/1971 | Kitchen | | |
| 4,944,366 A | 7/1990 | Pryor | | |
| 5,299,906 A | 4/1994 | Stone | | |
| 5,426,896 A * | 6/1995 | Sloma | E02D 31/10 | 52/2.13 |
| 5,492,300 A * | 2/1996 | Riihiluoma | B66F 3/22 | 248/354.1 |
| 6,145,619 A * | 11/2000 | Risser | B66F 11/044 | 182/113 |
| 6,679,479 B1 | 1/2004 | Watkins | | |
| 6,929,249 B1 * | 8/2005 | Kim | B66F 3/35 | 254/2 B |
| 7,070,167 B1 * | 7/2006 | Bacon | B66F 7/0625 | 254/10 C |
| D672,523 S | 12/2012 | Taylor | | |
| 9,056,755 B1 * | 6/2015 | Moy | B66F 3/24 | |
| 9,540,829 B2 * | 1/2017 | Pathak | E04G 3/24 | |
| 9,975,747 B1 * | 5/2018 | Williams | B66F 3/35 | |
| 2008/0001130 A1 * | 1/2008 | Dibdin | B60P 1/02 | 254/93 HP |

(Continued)

FOREIGN PATENT DOCUMENTS

CN 2761570 Y 3/2006

*Primary Examiner* — Daniel P Cahn
(74) *Attorney, Agent, or Firm* — Kyle A. Fletcher, Esq.

(57) ABSTRACT

The inflatable scaffolding is a self-erecting structure that forms a raised working platform similar to a scaffolding. The inflatable scaffolding comprises a plurality of inflatable bladders, a flooring, a guarding, a ladder, and a pump. The plurality of inflatable bladders is a stack of bladders. When pressurized air provided by the pump inflates one or more bladders selected from the plurality of bladders, the span of the distance of the vertical height is increased. The flooring and the guarding are located on the surface of the plurality of inflatable bladders distal from the supporting surface. When each of the one or more selected bladders is fully inflated, flooring and the guarding form a raised working platform that is similar to the structure commonly referred to as scaffolding. To erect the scaffolding to it greatest vertical height, all the inflatable bladders contained within the plurality of inflatable bladders are inflated.

13 Claims, 5 Drawing Sheets

(56) References Cited

U.S. PATENT DOCUMENTS

| | | | | |
|---|---|---|---|---|
| 2008/0116018 | A1* | 5/2008 | Wieland | A63G 31/12<br>187/401 |
| 2010/0264386 | A1* | 10/2010 | Dvorak | B66F 3/35<br>254/93 HP |
| 2011/0162911 | A1* | 7/2011 | Wieland | A63G 31/10<br>182/141 |
| 2014/0270987 | A1* | 9/2014 | Williamson | E02D 17/08<br>405/282 |
| 2016/0046312 | A1* | 2/2016 | Muller | B62B 3/0618<br>280/43.23 |
| 2017/0211765 | A1* | 7/2017 | Walker | F21S 9/03 |

* cited by examiner

INFLATABLE SCAFFOLDING

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of buildings including scaffoldings, more specifically, a scaffolding that primarily rests on the ground.

SUMMARY OF INVENTION

The inflatable scaffolding is a self-erecting structure that forms a raised working platform similar to a scaffolding. The inflatable scaffolding comprises a plurality of inflatable bladders, a flooring, a guarding, a ladder, and a pump. The plurality of inflatable bladders is a stack of bladders. When pressurized air provided by the pump inflates one or more bladders selected from the plurality of bladders, the span of the distance of the vertical height is increased. The flooring and the guarding are located on the surface of the plurality of inflatable bladders that is distal from the supporting surface. When each of the one or more selected bladders is fully inflated, the flooring and the guarding form a raised working platform that is similar to the structure commonly referred to as scaffolding. To erect the scaffolding to it greatest vertical height, all the inflatable bladders contained within the plurality of inflatable bladders are inflated.

These together with additional objects, features and advantages of the inflatable scaffolding will be readily apparent to those of ordinary skill in the art upon reading the following detailed description of the presently preferred, but nonetheless illustrative, embodiments when taken in conjunction with the accompanying drawings.

In this respect, before explaining the current embodiments of the inflatable scaffolding in detail, it is to be understood that the inflatable scaffolding is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the inflatable scaffolding.

It is therefore important that the claims be regarded as including such equivalent construction insofar as they do not depart from the spirit and scope of the inflatable scaffolding. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
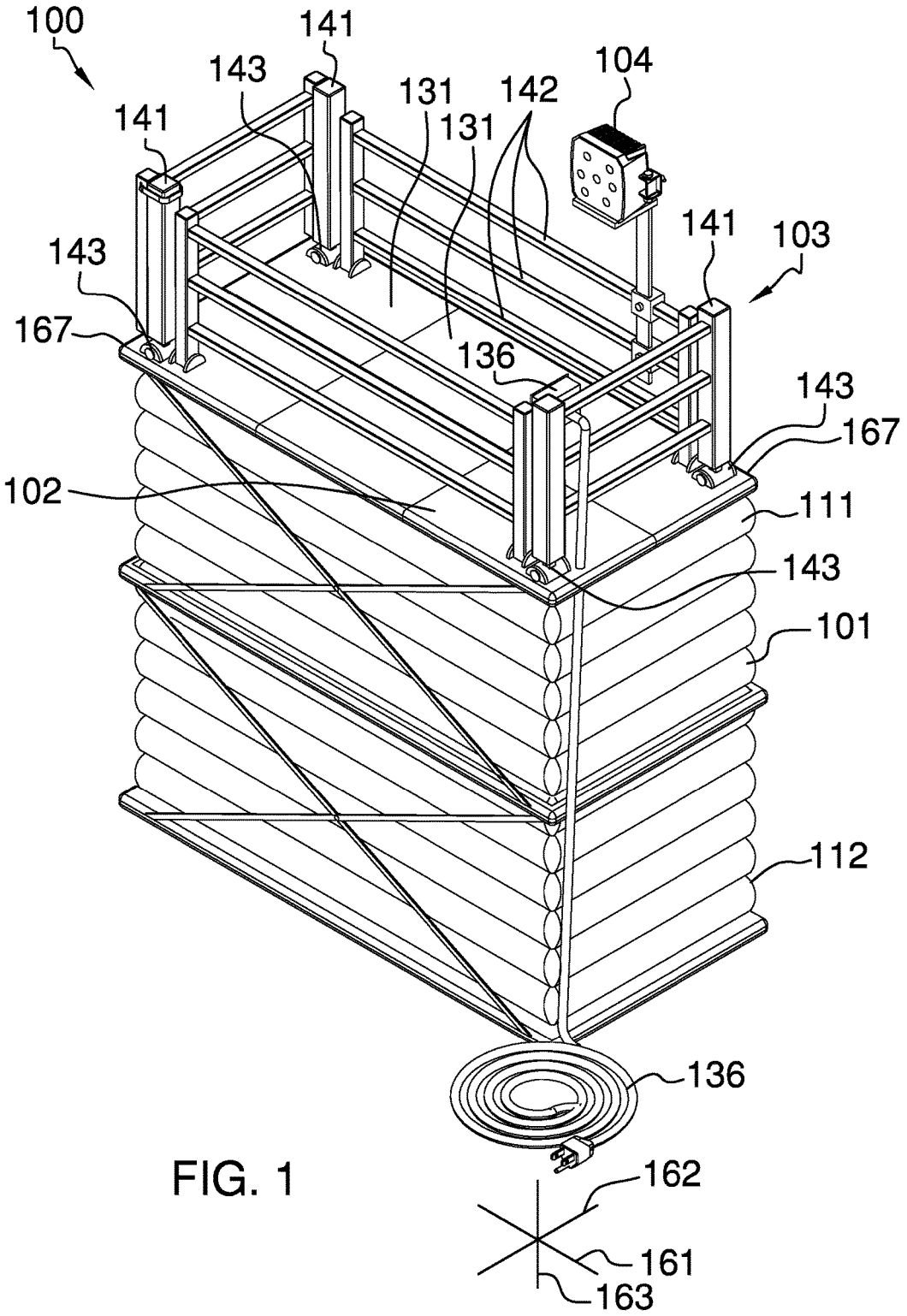
FIG. 1 is a perspective view of an embodiment of the disclosure.
Figure 2:
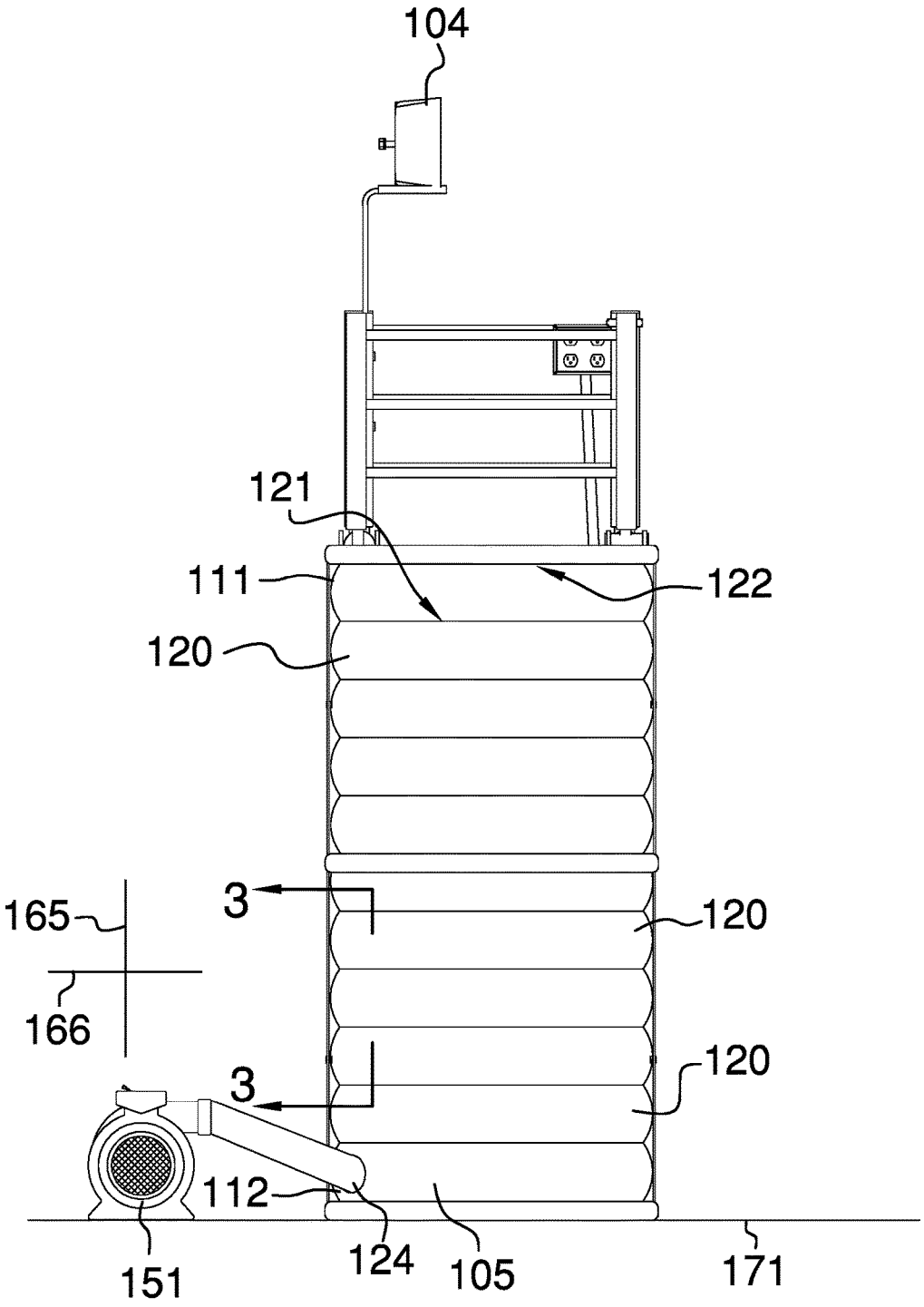
FIG. 2 is a rear view of an embodiment of the disclosure.
Figure 3:
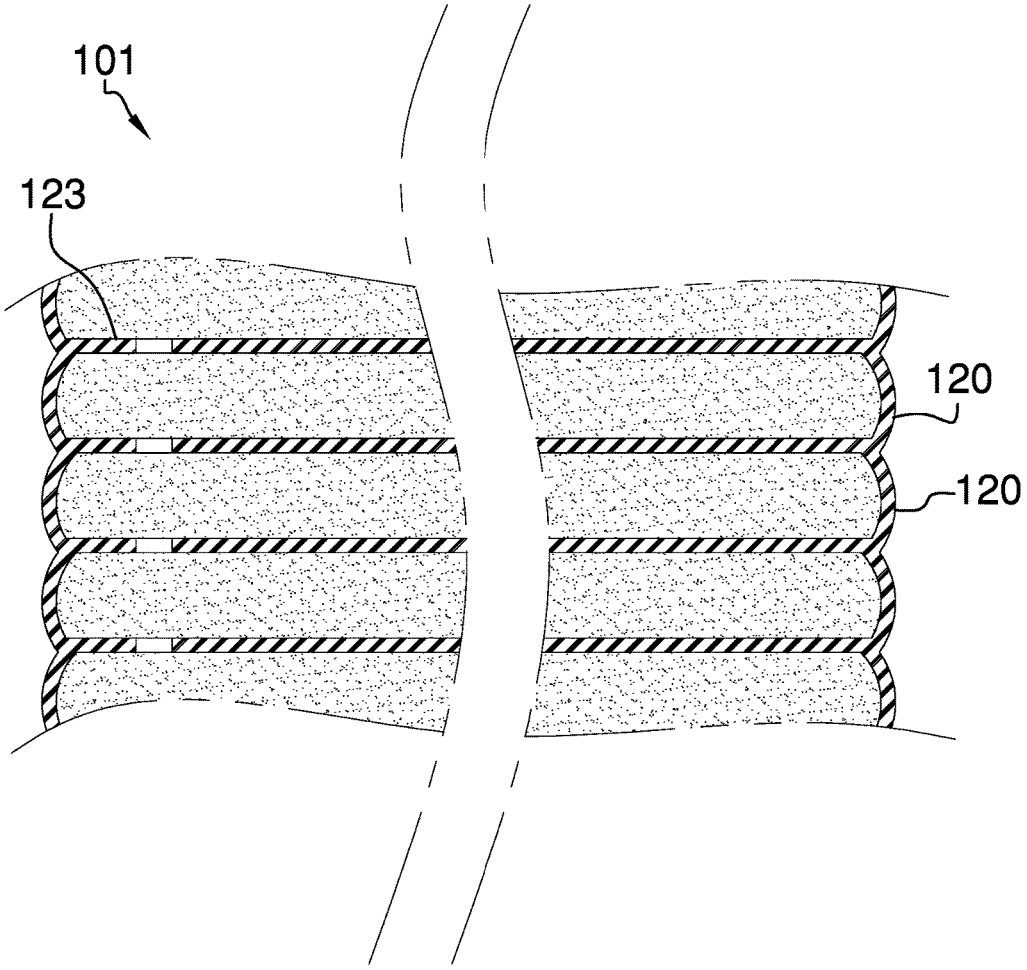
FIG. 3 is a cross-sectional view of an embodiment of the disclosure across 3-3 as shown in FIG. 2.
Figure 4:
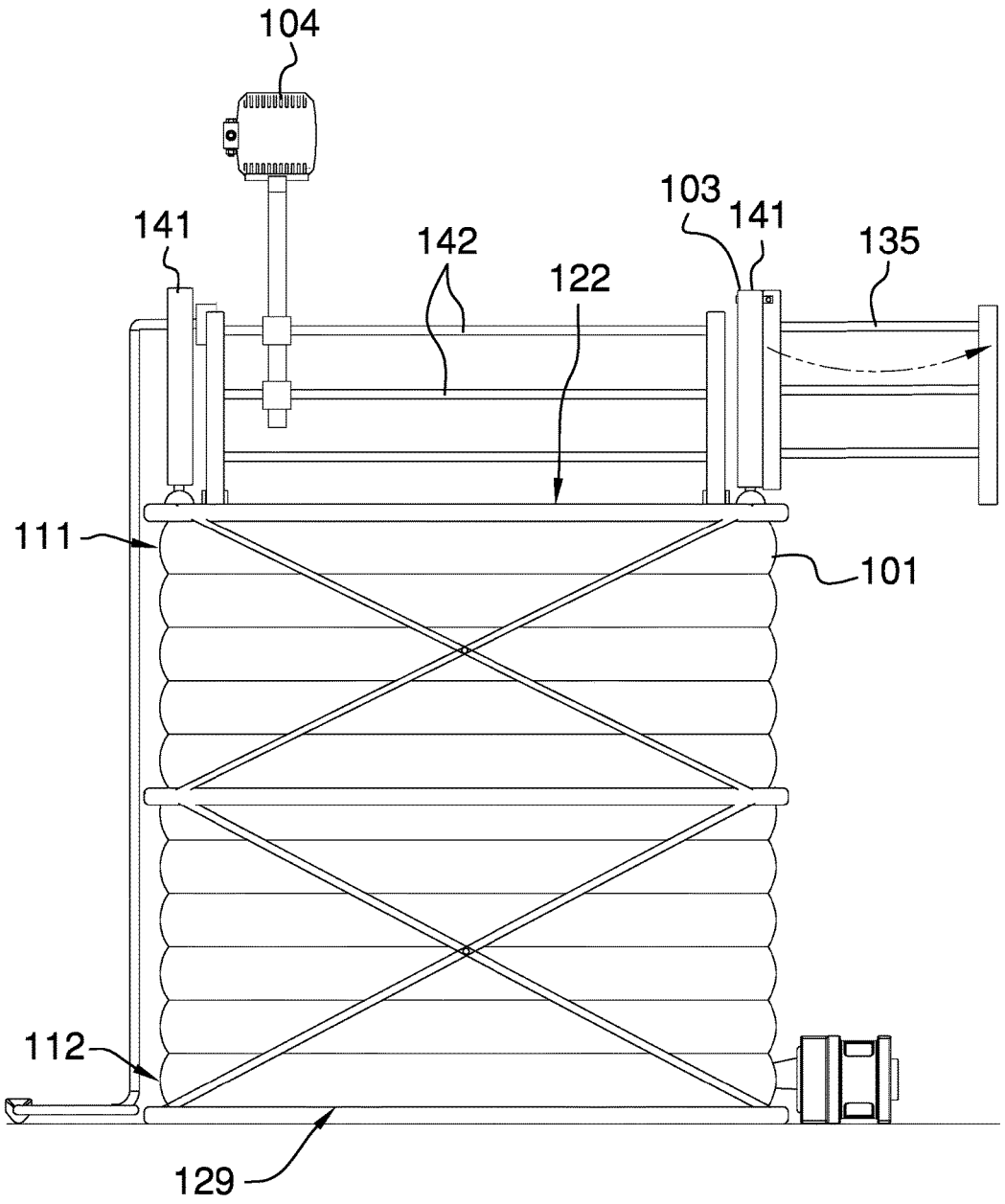
FIG. 4 is a side view of an embodiment of the disclosure.
Figure 5:
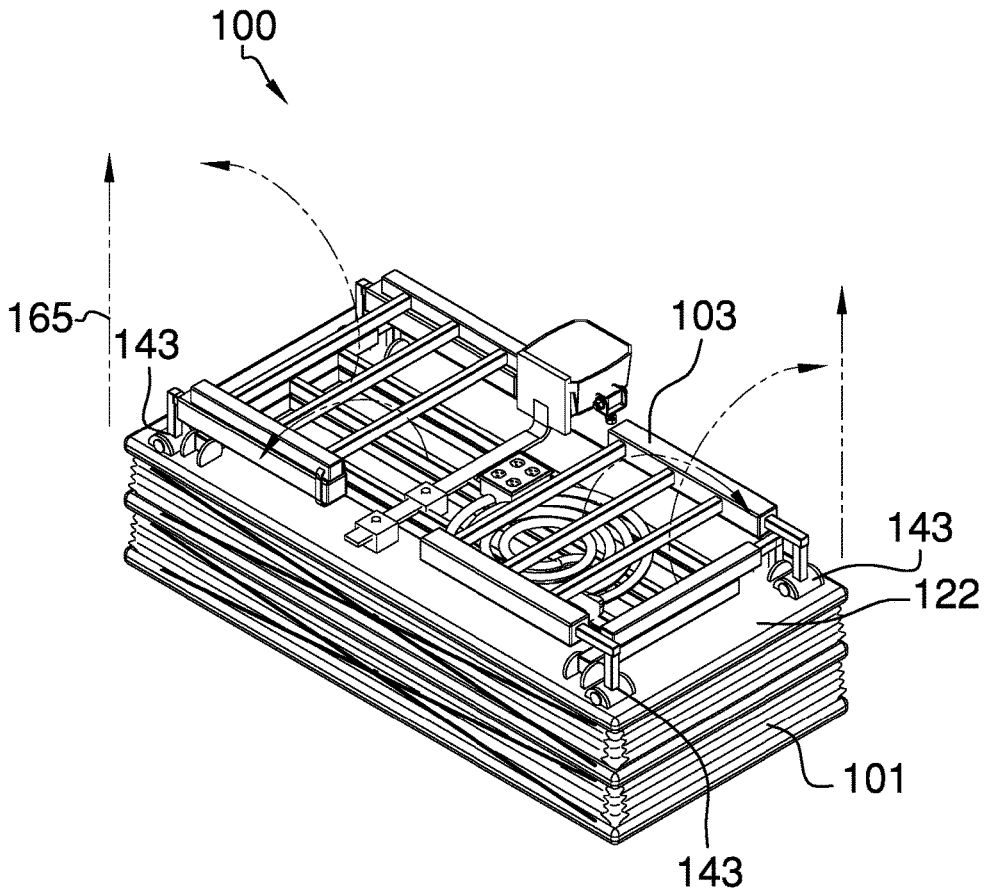
FIG. 5 is an in use view of an embodiment of the disclosure.

Detailed reference will now be made to one or more potential embodiments of the disclosure, which are illustrated in FIGS. 1 through 5.

The inflatable scaffolding 100 (hereinafter invention) is a self-erecting structure that forms a raised working platform similar to a scaffolding. The invention 100 comprises a plurality of inflatable bladders 101, a flooring 102, a guarding 103, a work light 104, and a pump 105. The plurality of inflatable bladders 101 is a stack of individual inflatable bladders 120. When pressurized air provided by the pump 105 inflates one or more inflatable bladders selected from the plurality of inflatable bladders 101 the span of the distance of the vertical 165 height 163 is increased. The flooring 102 and the guarding 103 are located on the surface of the plurality of inflatable bladders 101 that is distal from the supporting surface 171. When each of the one or more selected inflatable bladders is fully inflated, the flooring 102 and the guarding form a raised working platform that is similar to the structure commonly referred to as scaffolding. To erect the scaffolding to it greatest vertical 165 height 163, all the individual inflatable bladders 120 contained within the plurality of inflatable bladders 101 are inflated. The work light 104 provides lighting to the working platform created by the flooring 102 and guarding 103.

The invention 100 is further defined with a length 161, a width 162, a height 163, a vertical 165 direction, and a horizontal 166 direction. The length 161 refers to direction of the longest span of the invention 100 that is perpendicular to the direction of the height 163. The width 162 refers to direction and the span of the direction of the longest span of the invention 100 that is perpendicular to both the direction of the height 163 and the direction of the length 161. The vertical 165 direction is the direction that is perpendicular to the supporting surface 171. The height 163 is the span of the invention 100 that is parallel to the vertical 165 direction. The horizontal 166 direction is the direction that is parallel to the vertical 165 direction. The supporting surface 171 is a horizontal 166 surface upon which the first surface 121 of the bottom bladder 112 is placed.

The plurality of inflatable bladders 101 is a rectangular block shaped inflatable structure. The plurality of inflatable bladders 101 is the structure of the invention 100 that provides the vertical 165 lift for the formed working platform. The plurality of inflatable bladders 101 is further defined with a top bladder 111 and a bottom bladder 112. The top bladder 111 is the individual inflatable bladder 120 that is distal from the supporting surface 171. The bottom bladder 112 is the individual inflatable bladder 120 that is proximal to the supporting surface 171.

The plurality of inflatable bladders 101 comprises a collection of individual inflatable bladders 120. Any individual inflatable bladder 120 selected from the plurality of inflatable bladders 101 is identical to any individual bladder 120 remaining within the plurality of inflatable bladders 101.

The individual inflatable bladder 120 expands in the vertical 165 direction when pressurized air is pumped into the individual inflatable bladder 120. Each individual inflatable bladder 120 is an inflatable structure that is formed from a gas impermeable material. In the first potential embodiment of the disclosure, polyvinylchloride is used to form the individual inflatable bladder 120.

The individual inflatable bladder 120 is further defined with a first surface 121 and a second surface 122. The first surface 121 of each individual inflatable bladder 120 is the surface that is proximal to the supporting surface 171. The second surface 122 of each individual inflatable bladder 120 is the surface that is distal from the supporting surface 171.

Each individual inflatable bladder 120 further uses the pump 105. The pump 105 is a readily and commercially available pump 105 that controls the flow of air into and out of the individual inflatable bladder 120. Methods to mount pump 105 on bladders are well known and documented in the mechanical arts.

The plurality of inflatable bladders 101 is assembled by attaching the first surface of a first individual inflatable bladder 120 selected from the plurality of inflatable bladders 101 to the second surface 122 of a second individual inflatable bladder 120 selected from the plurality of inflatable bladders 101.

The flooring 102 is a supporting structure placed on the second surface 122 of the top bladder 111 upon which people working on the invention 100 will stand. The flooring 102 is formed as a rigid or semi-rigid structure that distributes the supported weight across the entire second surface 122 of the top bladder 111. The flooring 102 comprises a plurality of one or more panels 131. Each of the plurality of one or more panels 131 is a rigid or semi-rigid plate structure. The flooring 102 mounts on the second surface 122 of the top bladder 111 of the plurality of inflatable bladders 101. The plurality of one or more panels 131 are attached to each other using commercially available hardware.

The guarding 103 is a safety device that indicates the safe working area of the second surface 122 of the top bladder 111. The guarding 103 comprises a plurality of corner posts 141 and a plurality of lines 142. The guarding 103 mounts on the flooring 102. Each of the plurality of corner posts 141 is a cylindrical pipe that projects perpendicularly away from the surface formed by the flooring 102. Each of the plurality of corner posts 141 is located in a corner 167 of the rectangle formed by the flooring 102. As shown most clearly in FIG. 5, each of the plurality of corner posts is mounted on a pivot 143. The pivot 143 is a hinged apparatus that allows the associated corner post selected from the plurality of corner posts 141 to rotate such that the selected corner post will lie flat on the working surface formed by the invention 100. The plurality of lines 142 comprise a readily and commercially available cord selected from the group consisting of a rope or a chain. The plurality of lines 142 are strung between two corner posts selected from the plurality of corner posts 141 such that a boundary is formed within which is contained an area deemed safe to operate within.

The pump 105 is an apparatus that pumps pressurized air into the plurality of inflatable bladders 101 in order to raise the plurality of inflatable bladders 101 vertically 165. The pump 105 comprises an air pump 151 and a manifold 152. The air pump 151 is a readily and commercially available air pump 151. The manifold 152 is a piping apparatus that interconnects the air pump 151 to each individual inflatable bladder 120 such that air can be pumped into each individual inflatable bladder 120. The air pump 151 attaches to the manifold 152 such that the manifold 152 interconnects the pump 105 each individual inflatable bladder 120 selected from the plurality of inflatable bladders 101.

The work light 104 is a readily and commercially available lighting device that illuminates the workspace created by the invention 100.

In a second potential embodiment of the disclosure, the invention 100 further comprises a gate 135 and a plurality of electrical outlets 136. The plurality of electrical outlets 136 provide access from the working platform of the invention 100 to the electrical energy provided through the national electric grid. Methods to provide access to the national electric grid are well known and documented in the electrical arts. The gate 135 is a rotating structure that permits access through the guarding 103 in lieu of having to climb over the guarding 103. Methods to form gates through barriers such as the guarding 103 are well known and documented in the mechanical arts.

To use the invention 100, the flooring 102 and the guarding 103 are mounted on the second surface 122 of the top bladder 111 to form the working platform. One or more individual inflatable bladders 120 are selected from the plurality of inflatable bladders 101 such that an appropriate vertical 165 height 163 will be achieved by the working platform when the one or more selected individual inflatable bladders 120 are inflated. The air pump 151 pumps air into each selected individual inflatable bladder 120 to inflate the plurality of inflatable bladders 101. The air pump 151 remains on through the use of the invention 100 to provide make up air for any leakages that may occur during use of the invention 100.

The following definitions were used in this disclosure:

Bladder: As used in this disclosure, a bladder is gas impermeable structure. The internal volume of the structure can be varied by: varying the pressure and or quantity of a gas contained within the bladder; or 2) varying the quantity of a liquid contained within the bladder. Bladders are commonly used for storage of a gas or liquid and as a cushion.

Cord: As used in this disclosure, a cord is a long, thin, and flexible piece of string, line, rope, or chain.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Manifold: As used in this disclosure, a manifold is a pipe or chamber having several ports through which liquid or gas is gathered or distributed.

Plate: As used in this disclosure, a plate is a smooth, flat and rigid object that has at least one dimension that: 1) is of uniform thickness; and 2) that appears thin relative to the other dimensions of the object. Plates often have a rectangular or disk like appearance. As defined in this disclosure, plates may be made of any material, but are commonly made of metal.

Rigid Structure: As used in this disclosure, a rigid structure is a solid structure that is inflexible and will not deform before breaking under a force.

Scaffolding: As used in this disclosure, a scaffolding is a temporary structure that provides a raised working platform upon which maintenance and repair activities on a building or other tall structure can be performed.

Semi-Rigid Structure: As used in this disclosure, a semi-rigid structure is a solid structure that is stiff but not wholly inflexible and that will deform under force before breaking. A semi-rigid structure may or may not behave in an elastic fashion in that a semi-rigid structure need not return to a relaxed shape.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A temporary structure comprising:

a plurality of inflatable bladders comprising a top bladder, a bottom bladder, and middle bladders;

a flooring, a guarding, a work light, and a pump;

wherein the temporary structure forms a raised working platform;

wherein the temporary structure is placed on a supporting surface;

wherein, when pressurized air provided by the pump inflates one or more of the inflatable bladders, a span of a distance of a vertical height is increased;

wherein the flooring is located on a top surface of the top bladder which is distal from the supporting surface, and the guarding is located on the flooring;

wherein the work light is configured to provide illumination;

wherein the temporary structure is further defined with a length, a width, a height, a vertical direction, and a horizontal direction;

wherein the supporting surface is a horizontal surface upon which a bottom surface of the bottom bladder is placed;

wherein the inflatable bladders form a substantially rectangular block shaped structure;

wherein the inflatable bladders are configured to provide a vertical lift for the raised working platform;

wherein the top bladder is more distal from the supporting surface than the bottom and middle bladders;

wherein the bottom bladder is more proximal to the supporting surface than the top and middle bladders;

wherein each bladder of the inflatable bladders is identical to each other;

wherein each said bladder is substantially rectangular in order to form the substantially rectangular block shaped structure;

wherein each said bladder is further defined with a first surface and a second surface;

wherein the first surface of each said bladder is a horizontal surface more proximal to the supporting surface than the second surface of each respective said bladder, the bottom surface of the bottom bladder is the first surface of the bottom bladder;

wherein the second surface of each said bladder is a horizontal surface that is more distal from the supporting surface than the first surface of each respective said bladder, the top surface of the top bladder is the second surface of the top bladder;

wherein the first surface of the top and middle bladders respectively is attached to the second surface of one of the bottom and middle bladders respectively;

wherein the flooring is a supporting structure placed on the second surface of the top bladder, the guarding is configured to prevent a worker from falling off of the flooring, and the guarding defines a boundary located within an area defined by the top bladder to indicate a safe working area upon the flooring for the worker;

wherein each said bladder is formed from a gas impermeable material; and, wherein each said bladder expands in the vertical direction when pressurized air is pumped through the material of the first surface of each said bladder as a result of the pump being actuated.

2. The temporary structure according to claim 1 wherein the flooring is formed as a structure selected from the group consisting of: a rigid structure and a semi-rigid structure.

3. The temporary structure according to claim 2 wherein the flooring comprises a plurality of one or more panels.

4. The temporary structure according to claim 3 wherein the plurality of one or more panels are attached to each other.

5. The temporary structure according to claim 4 wherein the guarding comprises a plurality of corner posts and a plurality of lines;

wherein the guarding mounts on the flooring.

6. The temporary structure according to claim 5, wherein each of the plurality of corner posts is a cylindrical pipe that projects perpendicularly away from the second surface of the top bladder;

wherein each of the plurality of corner posts is located in a corner of a rectangle formed by the flooring;

wherein the plurality of lines comprises a cord selected from the group consisting of: a rope and a chain.

7. The temporary structure according to claim 6 wherein the plurality of lines are strung between two corner posts selected from the plurality of corner posts such that the boundary is formed.

8. The temporary structure according to claim 7 wherein the pump is an apparatus that pumps pressurized air into the plurality of inflatable bladders in order to raise the plurality of inflatable bladders vertically.

9. The temporary structure according to claim 8 wherein the pump comprises an air pump and a manifold;

wherein the manifold is a piping apparatus that interconnects the air pump to each said bladder such that air can be pumped into each said bladder.

10. The temporary structure according to claim 9 wherein the air pump attaches to the manifold such that the manifold interconnects the pump to each said bladder.

11. The temporary structure according to claim 10 wherein the work light is positioned on the working platform of the temporary structure.

12. The temporary structure according to claim 11 wherein the air pump is configured to remain on through use of the temporary structure to provide make up air for any leakages that may occur during use of the temporary structure.

13. The temporary structure according to claim 12 wherein polyvinylchloride is used to form each said bladder.

* * * * *